US006523980B2

(12) United States Patent
Sejkora et al.

(10) Patent No.: US 6,523,980 B2
(45) Date of Patent: Feb. 25, 2003

(54) OPTICAL ELEMENT FOR DEFLECTING LIGHT BEAMS AND METHOD OF PRODUCTION

(75) Inventors: Günther Sejkora, Schwarzenberg (AT); Siegfried Bickel, Hohenems (AT)

(73) Assignee: Zumtobel Staff GmbH, Dornbirn (AT)

( * ) Notice: Subject to any disclaimer, the term of this patent is extended or adjusted under 35 U.S.C. 154(b) by 80 days.

(21) Appl. No.: 09/764,423

(22) Filed: Jan. 19, 2001

(65) Prior Publication Data

US 2001/0002878 A1 Jun. 7, 2001

Related U.S. Application Data

(63) Continuation of application No. PCT/EP00/03570, filed on Apr. 19, 2000.

(30) Foreign Application Priority Data

May 20, 1999 (DE) ..... 199 23 225

(51) Int. Cl.[7] ..... F21Y 5/02

(52) U.S. Cl. ..... 362/339; 362/223; 362/290; 362/327; 362/339; 362/354; 362/150

(58) Field of Search ..... 362/223, 339, 362/327

(56) References Cited

U.S. PATENT DOCUMENTS 3,129,895 A * 4/1964 Franck ..... 359/592
3,163,367 A * 12/1964 Bodian ..... 362/330
3,179,796 A * 4/1965 Rolph ..... 362/330
3,532,876 A * 10/1970 Müller et al. ..... 362/330
3,716,710 A * 2/1973 Clostermann et al. ..... 362/330
3,764,800 A * 10/1973 Clostermann ..... 362/330
3,829,680 A * 8/1974 Jones ..... 362/330
5,481,385 A 1/1996 Zimmerman et al.
5,598,281 A 1/1997 Zimmerman et al. ..... 359/5
5,718,497 A * 2/1998 Yokoyama et al. ..... 362/26
5,839,823 A 11/1998 Hou et al. ..... 362/327

FOREIGN PATENT DOCUMENTS

AT 403 403 B 2/1998
WO 97 36131 A 10/1997

* cited by examiner

*Primary Examiner*—Sandra O'Shea
*Assistant Examiner*—Ismael Negron
(74) *Attorney, Agent, or Firm*—Fitzpatrick, Cella, Harper & Scinto

(57) ABSTRACT

An optical element for deflecting light beams is formed form a plate-like core or element 1 of transparent material having tapered microprisms 2 one side, with furrows 7 formed between the microprisms, the furrows being covered with a reflective layer 12, and a foil 11 of transparent material arranged on a side of the reflective layer remote from the core or element 1.

29 Claims, 2 Drawing Sheets

OPTICAL ELEMENT FOR DEFLECTING LIGHT BEAMS AND METHOD OF PRODUCTION

CROSS REFERENCE TO RELATED APPLICATIONS

This is a Continuation of copending International Application No. PCT/EP00/03570, filed Apr. 19, 2000 and published in German, but not in English, on Nov. 30, 2000, the priority of which is claimed.

BACKGROUND OF THE INVENTION

1. Field of the Invention

The present invention relates to an optical element for deflecting light beams, which enter and re-emerge from the latter, in such a way that their angle of emergence is limited, for use as a luminaire-cover for example, and a reflective element as a component of the optical element, as well as to corresponding methods for the production of the optical element and the reflective element.

As a result of using optical elements of the kind mentioned by way of introduction, the angle of emergence of light beams, from a luminaire for example, is limited in order to diminish any dazzlement for the viewer. In addition, of course, such an element also provides mechanical protection for the luminaire and in particular for the light source in the interior of the luminaire.

2. Description of the Related Art

Such an optical element is known, for example, from the Austrian Patent AT-B-403,403. The known element has on its side facing the lamp of the luminaire, pyramidal profiled portions that are arranged in rows and lines, so-called microprisms, which are formed as truncated pyramids and have an upper boundary face (light-entry face) that lies parallel to the base (light-emergence face). An optical element that is known from AT-B-403,403 is shown in FIG. 1 for the purposes of explanation. The whole element is made totally of a crystal-clear or transparent material.

A further optical element of the kind mentioned by way of introduction is disclosed, for example, in WO 97/36131. Various measures are known from this printed specification for preventing light beams from the lamp of the luminaire from penetrating into the intermediate areas or furrows between the top surfaces of the microprisms that form the light-entry faces, since such light beams would not emerge from the optical element at a desired angle of emergence. FIGS. 16–24 and the associated description of this printed specification, for example, disclose the possibilities of filling up the furrows between the microprisms with a filling compound that has reflective properties, coating the side walls of the microprisms with a reflective material, covering the microprism structure with a reflective mask or a grid, or providing combinations of these measures. Since the dimensions of the microprisms only lie in the range of a few hundred $\mu$m, a high level of precision is required when producing such optical elements or luminaire-covers.

SUMMARY OF THE INVENTION

Basing considerations on the afore-mentioned prior art it is an object of the present invention to provide an optical element of the kind mentioned by way of introduction that has a reflective layer and which is simple to construct and therefore also to produce and at the same time has a stable structure and a high luminous quality level.

A further object of the present invention is to provide a reflective element for such an optical element that is simple to construct and therefore also to produce and at the same time guarantees a stable structure and a high luminous quality level of the whole optical element.

The optical element consists of a plate-like core of transparent material which on one side is occupied by microprisms that taper forming furrows—starting from their root—with, for example, all of the top surfaces of the microprisms forming the light-entry face and the other side of the core forming the light-emergence face, and with the furrows being covered by a layer that is reflective at least on one side. In accordance with the invention, furthermore, a foil of transparent material is provided that is arranged on the side of the reflective layer that is remote from the element core. The foil gives the reflective layer independent stability, something which, on the one hand, facilitates the handling thereof when the whole optical element is produced and, on the other hand, also increases the stability of the element as a whole. Furthermore, the assembly of such a reflective element on the element core of the optical element with the necessarily high level of precision is simpler to effect than the direct application of, for example, a thin metal foil to the intermediate areas of the microprism structure, as necessary in the case of the systems known previously.

The reflective layer is preferably fixedly connected to the transparent foil, in particular is welded together therewith or adhered thereto. In particular, welding has the advantage here that there is no further material component present in the system that has a refractive index which would need to be taken into consideration with regard to the luminous properties of the optical element. It is, however, also possible in the first instance to apply to, preferably vapour-deposit onto, the transparent foil a metal layer in which the desired structure is subsequently formed, something which can be effected both mechanically and by means of laser beams or else chemically.

Furthermore, a reflective layer is also preferably fixedly connected to the element core, in particular adhered thereto or welded together therewith. The connection of the reflective layer can then be effected both subsequently to prefabrication of the reflective element consisting of the reflective layer and the transparent foil and also in a joint method step at the same time as the connection of the reflective layer to the transparent foil.

Further advantageous configurations and further developments of the present invention constitute subject matter of further subclaims.

BRIEF DESCRIPTION OF THE DRAWINGS

The invention is described in greater detail in the following with the aid of various preferred exemplary embodiments with reference to the enclosed drawing, in which.

DETAILED DESCRIPTION OF THE PREFERRED EMBODIMENTS

The optical element in accordance with the present invention that is described below is suitable in particular as a covering for luminaires, the angle of emergence of light of which is to be limited in order to avoid dazzlement for a viewer.

Figure 1:
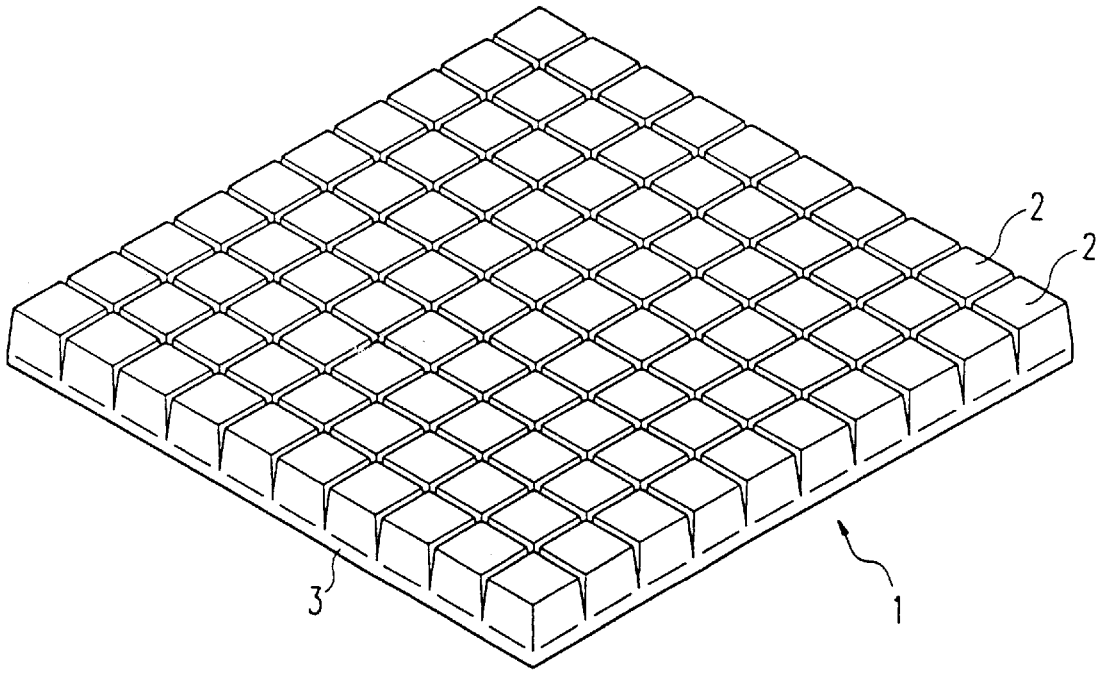
Fig. 1 Prior Art
FIG. 1 shows a diagrammatic perspective representation of a luminaire-cover, known from the prior art, from the viewing direction of the (imaginary) lamp.

FIG. 1 shows a perspective view of a known luminaire-cover or a known optical element, as is also used as a component part of the present invention. The known luminaire-cover has, on its side facing the lamp or even the lamps (not shown) of the luminaire, pyramidal profiled portions 2 which are arranged in rows and lines, so-called microprisms, formed as truncated pyramids on a base. The whole luminaire-cover is made totally from a crystal-clear or transparent material, such as, for example, acrylic glass. The known luminaire-cover, which is shown in FIG. 1, at the same time constitutes an embodiment of a core 1 for an optical element 9 in accordance with the invention, as will be described further in greater detail below.

The core 1 of the luminaire-cover is plate-like and transparent and on one side is occupied by portion 2 in the form of microprisms that taper forming furrows 7—starting from their root 5—with all of the top surfaces 4 of the microprisms forming the light-entry face and the other side of the core 1 forming the light-emergence face 3. The angle of emergence of the light beams —emerging downwards from the optical element shown in FIG. 1—is to amount at most to approximately 60–70° relative to the perpendicular of the emergence face 3 in order to avoid or at least to minimize dazzlement for the viewer.

Alternatively, it is also possible for the core 1 to be inserted in such a way that all of the top surfaces 4 of the microprisms form the light-emergence face and the other side of the core forms the light-entry face.

The intermediate areas or furrows between the individual microprisms in the present case are spaced apart from each other by approximately 700 $\mu$m and in the plane of the top surface 4, namely the light-entry faces, are approximately 150 $\mu$m wide.

If light from the lamp penetrates into these furrows 7, it is not possible to guarantee that these beams of light will emerge from the light-emergence face 3 of the optical element at the desired angle of emergence. It is therefore necessary to fill up or cover the furrows 7 between the light-entry faces or top surfaces 4, as already known from WO 97/36131. The material for this filling or covering may not, however, be light-absorptive so that the degree of efficiency of the optical element or the luminaire-cover is not reduced. A reflective material should therefore be used which, as far as possible, gives rise to total reflection of the incident light without light absorption. In this way, the light is reflected back in the direction of the lamp, this generally being provided with reflectors that are arranged at the back so that substantially all of the light radiated from the lamp of the luminaire leaves the optical element through the top surface 4, i.e. the light-entry faces and the light-emergence faces, 3 and a high degree of luminous efficiency is guaranteed. In particular, metals that have a high reflecting power, such as, for example, silver, aluminum or gold, or the like, are therefore suitable as a covering material for the furrows 7.

Figure 2:
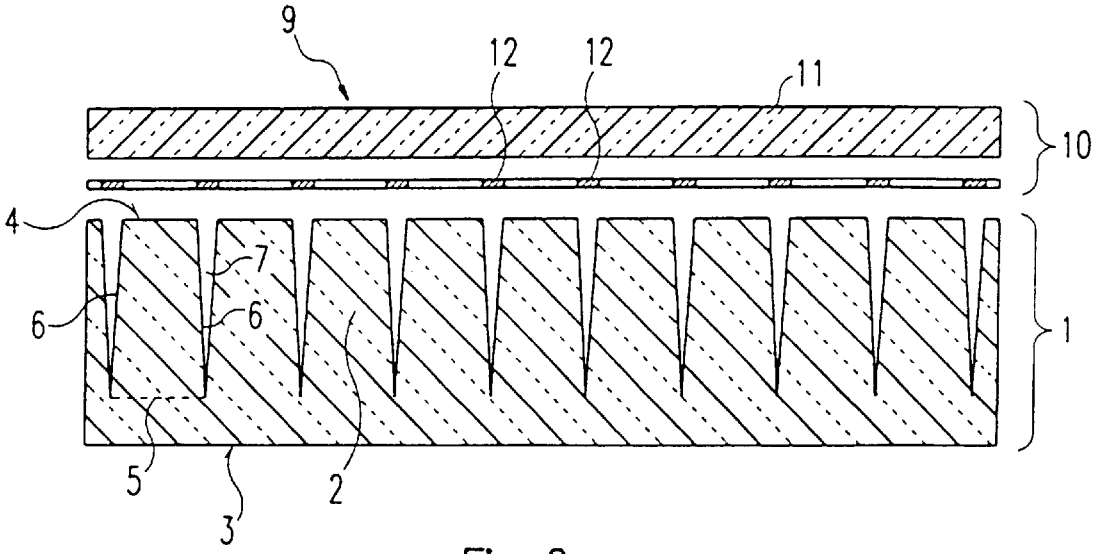
FIG. 2 shows a diagrammatic cross-sectional representation of an optical element with components in accordance with the present invention that are shown separately.
Figure 3:
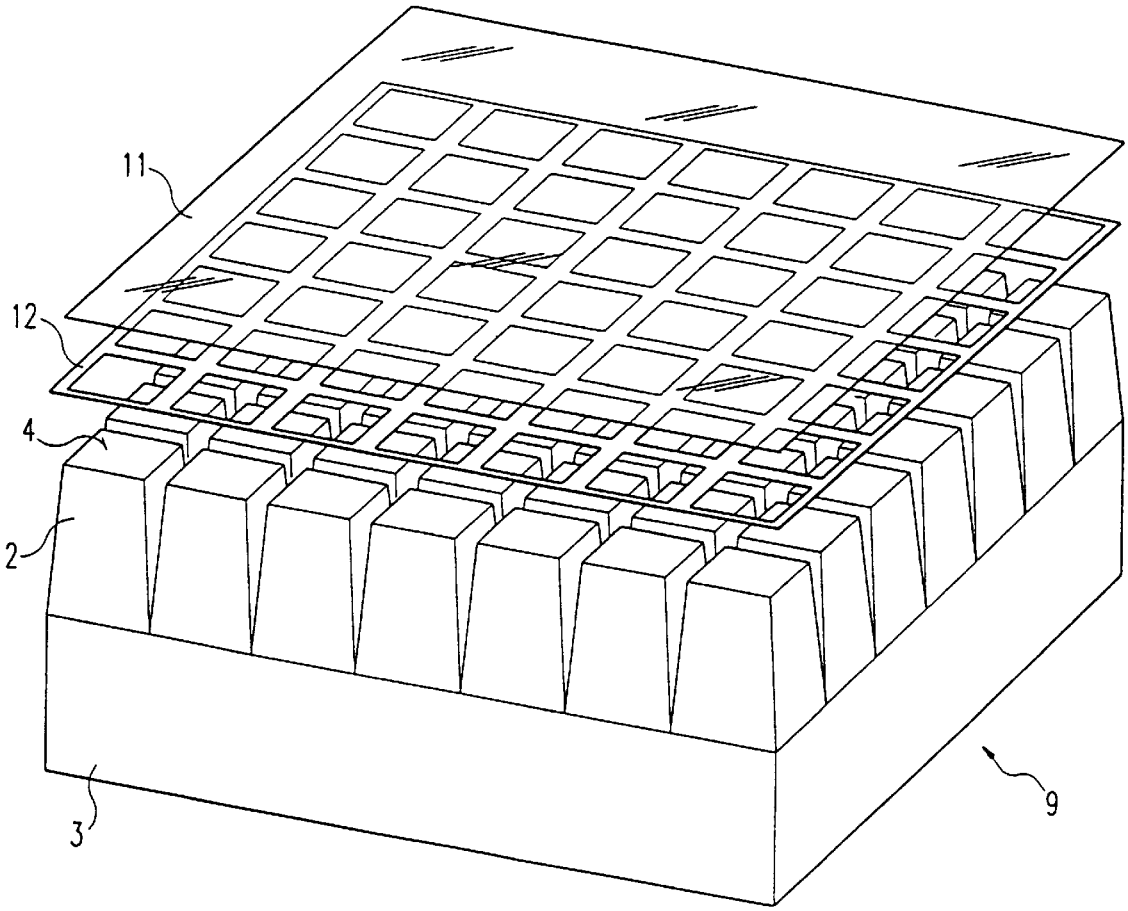
FIG. 3 shows a perspective representation of the optical element of FIG. 2.

The embodiment of the optical element 9 in accordance with the invention differs from the known luminaire-cover in accordance with FIG. 1 in that a reflective element 10 is applied on the side of the element core 1 that has the portion 2 in the form of microprisms, as diagrammatically shown in FIGS. 2 and 3 in section and in a perspective view respectively. In order to provide a better representation of the structure of the optical element 9 in accordance with the invention, the components are shown separately in FIGS. 2 and 3. These components are of course directly in contact with each other or connected to each other in the practical realization thereof.

The core 1 has, for example, the arrangement that is shown in FIG. 1. The invention is not, however, restricted to this arrangement of the microprisms in rows and lines (cross structure) and to the microprisms that have a square base. On the contrary, the portions 2 in the form of microprisms can also have an elongated base and just be arranged in rows side by side (longitudinal structure). It is also possible to combine two transparent cores 1 that have a longitudinal structure and arrange them one on top of the other, with the one longitudinal structure being twisted by 90° in relation to the other longitudinal structure in the plane of the light-emergence face 3 so that all in all a similar effect as in the case of the cross structure is attained. Furthermore, basically any basic forms of the microprisms 2 are also possible, although as far as possible these should be in the form of a uniform polygon or a circle so that the shape of a reflective layer 12 described further below does not become unnecessarily complicated.

The core 1 of the optical element 9 in accordance with the invention can be produced in various ways from a transparent material, preferably a transparent plastics material, such as acrylic glass. The production by means of a so-called injection-molding embossing method is to be mentioned first here. This method is similar to the plastics injection-molding method that is generally known, yet is effected with a comparatively low injection pressure. After the transparent material has been injected into the mold, a mechanical pressure is exerted on the still liquid material so that the latter can penetrate into the structures of the mold. Furthermore, it is also possible to produce the core 1 by means of a hot-embossing method in which the transparent material in liquid form is poured into a corresponding mold and subsequently pressure is likewise applied thereto in order to realize the embossing.

Furthermore, there is also the possibility of providing a transparent plastics block with the furrows mechanically. This can be effected, for example, by cutting, for example with a diamond cutter, or by means of a laser beam.

A further possibility for producing the transparent core 1 consists in pressing the liquid plastics material through an extrusion head. In this case though it is only possible to produce linear structures of the portion 2 in the form of microprisms.

A reflective element 10 is applied on the side of the core 1 that faces the lamp of the luminaire, that is, on the plane of the top surfaces 4 of the microprisms that form the light-entry face. The reflective element 10 substantially consists of a foil or a thin plate 11 made from a transparent material and a layer 12 made from a reflective material. The same material that is used for the element core 1 is preferably used for the foil 11. It is possible to use both a plate, as shown in FIG. 2, and also a foil, as shown in FIG. 3, as a transparent foil or thin plate 11. In particular, the metals that have already been mentioned above and which have reflective properties or materials that have a similarly high reflecting power come into consideration for the reflective layer 12.

According to a first exemplary embodiment of the present invention, the transparent foil or thin plate 11 and the reflective layer 12 are two separate components which are fixedly connected together before they are connected to the element core 1. The reflective layer 12 having a grid or line structure is, for example, produced galvanically for this or is stamped out of metal foils. The layer 12 is preferably connected to the foil 11 by means of adhesion or welding. Welding the two components together is currently preferred, since in this case no further material in the form of a transparent adhesive substance is contained in the reflective element 10 that has a refractive index that is to be taken into consideration for the optical properties of the optical element 9.

A transparent adhesive, such as, for example an adhesive substance, an adhesive foil or a hot-melt-type adhesive, is used to adhere the transparent foil or thin plate 11 and the layer 12 together. The reflective layer 12 is advantageously heated for the purpose of welding the reflective layer 12 together with the foil or thin plate 11 and pressure is subsequently applied to the connection. The reflective layer 12 is heated in this connection, for example, by applying a magnetic alternating field to the layer 12, which may be in a metal grid. Eddy currents are induced in the metal grid 12 by means of the magnetic alternating field and these heat the metal. Alternatively, it is also possible to weld the reflective layer 12 together with the transparent foil or thin plate 11 by means of laser welding. In this connection, the layer 12 is in the form of a metal grid and welding is preferably effected locally at the edges of the layer 12.

According to a second exemplary embodiment of the reflective element 10, the foil or thin plate 11 and the layer 12, which may be a metal layer are produced as a unit. To this end, a reflective metal layer is first applied to, preferably vapor-deposited onto, the transparent foil or thin plate 11. Subsequently, the desired grid or line structure is introduced into the layer 12. This is preferably effected by punching by means of a laser beam or by punching mechanically. The desired structure can, however, also be worked out of the layer 12 by means of an etching process.

In comparison with an individual grid serving as the layer 12 or an individual grid foil, the reflective element 10 is substantially more stable and can therefore be handled more easily. This also facilitates the further production of the optical element 9. In addition, the stability of the reflective element 10 also increases the stability of the optical element 9 as a whole. The element 10 in accordance with the invention further guarantees exact application of the reflective layer 12 to the element core 1 or the furrows 7 and, as a result of the support of the foil or plate 11, constant alignment of the element 10 in relation to the microprisms 2 and their furrows 7.

The reflective element 10 or the reflective layer 12 respectively is preferably likewise connected to the transparent core 1 by means of adhesion or welding. In this connection, basically in turn the methods mentioned above for the connection of the reflective element 10 are possible.

In the case of the two-part reflective element 10, instead of prefabricating the element 10 it is also possible to arrange the three individual portions element core 1, metal grid 12 and transparent foil or thin plate 11 one on top of the other and to align them exactly in relation to one another and subsequently to connect them jointly in one single method step. The same methods that have already been mentioned above for the separate connection steps metal grid—foil and element core—reflective element, that is, in particular welding and adhesion, are suitable for the purposes of connection.

What is claimed is:

1. Optical element for deflecting light beams, which enter and re-emerge therefrom with a limited angle of emergence, said element comprising:

a plate-like core of transparent material, one side of which is occupied by microprisms that taper to form furrows between adjacent microprisms;

a layer that is reflective at least on one side and covers said furrows; and a foil of transparent material arranged on a side of the reflective layer remote from said core.

2. Optical element according to claim 1, wherein said reflective layer has a coherent grid structure.

3. Optical element according to claim 1, wherein said reflective layer is substantially made of metal.

4. Optical element according to claim 1, wherein said transparent core and said transparent foil are produced from the same material.

5. Optical element according to claim 1, wherein said reflective layer is fixedly connected to said core.

6. Optical element according to claim 5, wherein said reflective layer is adhered to or welded together with said core.

7. Optical element according to claim 1, wherein said reflective layer is fixedly connected to the transparent foil.

8. Optical element according to claim 7, wherein said reflective layer is adhered to or welded together with said transparent foil.

9. Optical element according to claim 7, wherein said reflective layer is vapor-deposited onto said transparent foil.

10. Method for producing an optical element according to claim 1, wherein said reflective layer is vapor deposited onto said transparent foil.

11. Method according to claim 10, wherein said structure of the reflective layer is formed by punching by one of a laser beam and mechanical punching.

12. In a method for producing an optical element having an element core, the steps of fixedly connecting a reflective layer to a transparent foil and subsequently fixedly connecting said reflective layer to said element core.

13. Reflective element for forming a portion of an optical element according to claim 1, said reflective element comprising a layer that is reflective on at least one side and which is dimensioned to cover the furrows of the core and to expose the top surfaces of the microprisms free, said layer being fixedly connectable to said foil of transparent material.

14. Reflective element according to claim 13, wherein said reflective layer is adhered to or welded together with a transparent foil.

15. Reflective element according to claim 13, wherein said reflective layer is vapor deposited onto the transparent foil.

16. Reflective element according to claim 13, wherein said reflective layer is substantially made of metal.

17. In a method for producing an optical element according to claim 1, the step of adhering or welding said reflective layer together with said transparent foil.

18. Method according to claim 17, wherein adhesion is effected by means of a transparent adhesive.

19. Method according to claim 17, wherein welding is effected by means of laser welding.

20. Method according to claim 17, wherein the welding is effected by heating the reflective layer.

21. Method according to claim 20, wherein said reflective layer is heated by applying an alternating magnetic field to generate eddy currents in said layer.

22. Method according to claim 10, wherein said structure of the reflective layer is formed out of said vapor deposited layer by means of an etching process.

23. Method according to claim 12, including the step of welding said reflective layer together with at least one of said transparent foil and said element core.

24. Method according to claim 23, wherein said welding is effected by means of laser welding.

25. Method according to claim 23, wherein said welding is effected by heating said reflective layer.

26. Method according to claim 25, wherein said reflective layer is heated by applying a magnetic alternating field in order to generate eddy currents in the layer.

27. In a method for producing an optical element having an element core, the step of adhering a reflective layer to at least one of a transparent foil and said element core.

28. Method according to claim 27, wherein said step of is effected by use of a transparent adhesive.

29. In a method for producing an optical element having an element core, the step of fixedly connecting a reflective layer to a transparent foil and in a joint step, fixedly connecting said reflective layer to said element core.

* * * * *